United States Patent [19]

Aichinger et al.

[11] 4,377,748

[45] Mar. 22, 1983

[54] X-RAY DIAGNOSTIC SYSTEM COMPRISING MEANS FOR THE FIXED SPECIFICATION OF EXPOSURE TIME, X-RAY TUBE VOLTAGE, AND MAS-PRODUCT

[75] Inventors: Horst Aichinger, Fuerth; Gerd Seifert, Spardorf, both of Fed. Rep. of Germany

[73] Assignee: Siemens Aktiengesellschaft, Berlin & Munich, Fed. Rep. of Germany

[21] Appl. No.: 142,703

[22] Filed: Apr. 22, 1980

[30] Foreign Application Priority Data

May 7, 1979 [DE] Fed. Rep. of Germany ..... 2918353

[51] Int. Cl.[3] ..... H05G 1/34

[52] U.S. Cl. ..... 378/110

[58] Field of Search ..... 250/415, 409, 413, 421

[56] References Cited

U.S. PATENT DOCUMENTS 2,512,193 6/1950 Zavales ..... 250/409
3,846,633 11/1974 Romandi ..... 250/421
3,978,339 8/1976 Aichinger ..... 250/402
4,160,906 7/1979 Daniels et al. ..... 250/415

FOREIGN PATENT DOCUMENTS 2116705 5/1977 Fed. Rep. of Germany .

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an exemplary embodiment, a control loop for the x-ray tube current is present which adjusts the x-ray tube current to a value which is a function of the exposure time and the selected mAs-product. In order that deviations of the x-ray tube voltage from a desired value can be controlled via the x-ray tube current, but that the mean value of the x-ray tube current can nevertheless be kept constant, a phase angle control device, arranged in the primary circuit of the high voltage transformer, can be present as the regulating unit for the mean value of the x-ray tube current. As controller for the x-ray tube voltage, a circuit for the adjustment of the filament current of the x-ray tube can be provided.

7 Claims, 2 Drawing Figures

X-RAY DIAGNOSTIC SYSTEM COMPRISING MEANS FOR THE FIXED SPECIFICATION OF EXPOSURE TIME, X-RAY TUBE VOLTAGE, AND MAS-PRODUCT

BACKGROUND OF THE INVENTION

The invention relates to an x-ray diagnostic system comprising means for the fixed specification of the exposure time of an x-ray photograph, as well as comprising adjustment means for selecting the setting of the x-ray tube voltage and the mAs-product.

An x-ray diagnostic system of this type is described in the German AS No. 2,116,705. The exposure time is here specified by a planigraphic apparatus for preparation of x-ray laminograms and is determined by the selected movement path of the x-ray tube and of the image layer carrier. In the case of the known x-ray diagnostic system, the computer determines, from the specified exposure time and the adjusted mAs-product, the necessary x-ray tube current and effects its adjustment in the x-ray diagnostic generator. In the case of an x-ray generator wherein the adjustment of the x-ray tube voltage proceeds via the filament current of the x-ray tube and the voltage drop at the generator internal resistance, brought about thereby, one is however, not free, with fixedly specified values for x-ray tube voltage, mAs-product, and exposure time, with regard to selection of the x-ray tube current; on the contrary, one is restricted to the operating points specified by the voltage drop curves. In addition, an exact observance of the adjusted mAs-product is not guaranteed in the case of a generator which determines the x-ray tube current via a computer circuit from mAs-product and exposure time and fixedly adjusts said x-ray tube current prior to the photographic exposure, since fluctuations of the x-ray tube current arising during a photographic exposure cannot be taken into account.

SUMMARY OF THE INVENTION

The object underlying the invention resides in designing an x-ray diagnostic system of the type initially cited such that the selected mAs-product is also exactly observed within the specified time.

This object is achieved in accordance with the invention by virtue of the fact that a control loop for controlling the x-ray tube current is present which controls the x-ray tube current on the basis of the fixed exposure time and the selected mAs-product. In the inventive x-ray diagnostic system the control loop for the x-ray tube current acts, in conjunction with the selection means for the mAs-product, as an mAs-control unit. The adjusted mAs-product is precisely observed during a photographic exposure due to deviation (error responsive) control.

A particularly expedient embodiment of the invention consists in that, for controlling the x-ray tube current, a keying circuit, arranged in the primary circuit of the high voltage transformer, is provided. Via this keying circuit the mean value of the x-ray tube current can be altered e.g. through influencing of the phase angle. It is thus possible to provide a control loop for the x-ray tube voltage which exhibits, as the control element, means for the adjustment of the filament current of the x-ray tube, so that the voltage drop in the x-ray diagnostic generator brought about by the x-ray tube current becomes so adjusted that the desired x-ray tube voltage is present. In this further development, deviations of the x-ray tube voltage from its desired (setpoint) value are controlled via the x-ray tube current and the voltage drop brought about thereby in the alternating current supply circuit (before the direct current x-ray tube circuit). The mean value of the x-ray tube current can be kept constant, independently of the control of x-ray tube voltage fluctuations, via the phase-angle control device, since, in the case of a change of the phase-angle, the mean value of the x-ray tube current and the peak value of the x-ray tube voltage do not run proportionally to one another. In case also the peak value of the x-ray tube voltage drops via the phase-angle and the altered waveform of the x-ray tube voltage connected therewith, the control element for the filament current intervenes and again returns the peak value of the x-ray tube voltage to the initial value.

The dose in the film plane is dependent not only upon the x-ray tube peak voltage and the selected mAs-value, but also upon the waveform of the x-ray tube voltage which likewise changes in case of a change in the phase angle. This behavior can be taken into account by a correction of the adjusted desired (setpoint) value for the x-ray tube voltage, in dependence upon the phase-angle, with the object of obtaining a fixed dose in the film plane which dose is independent of the waveform of the x-ray tube voltage.

The invention is explained in greater detail below on the basis of an exemplary embodiment illustrated on the accompanying drawing sheet; and other objects, features and advantages will be apparent from this detailed disclosure and from the appended claims.

DETAILED DESCRIPTION

Figure 1:
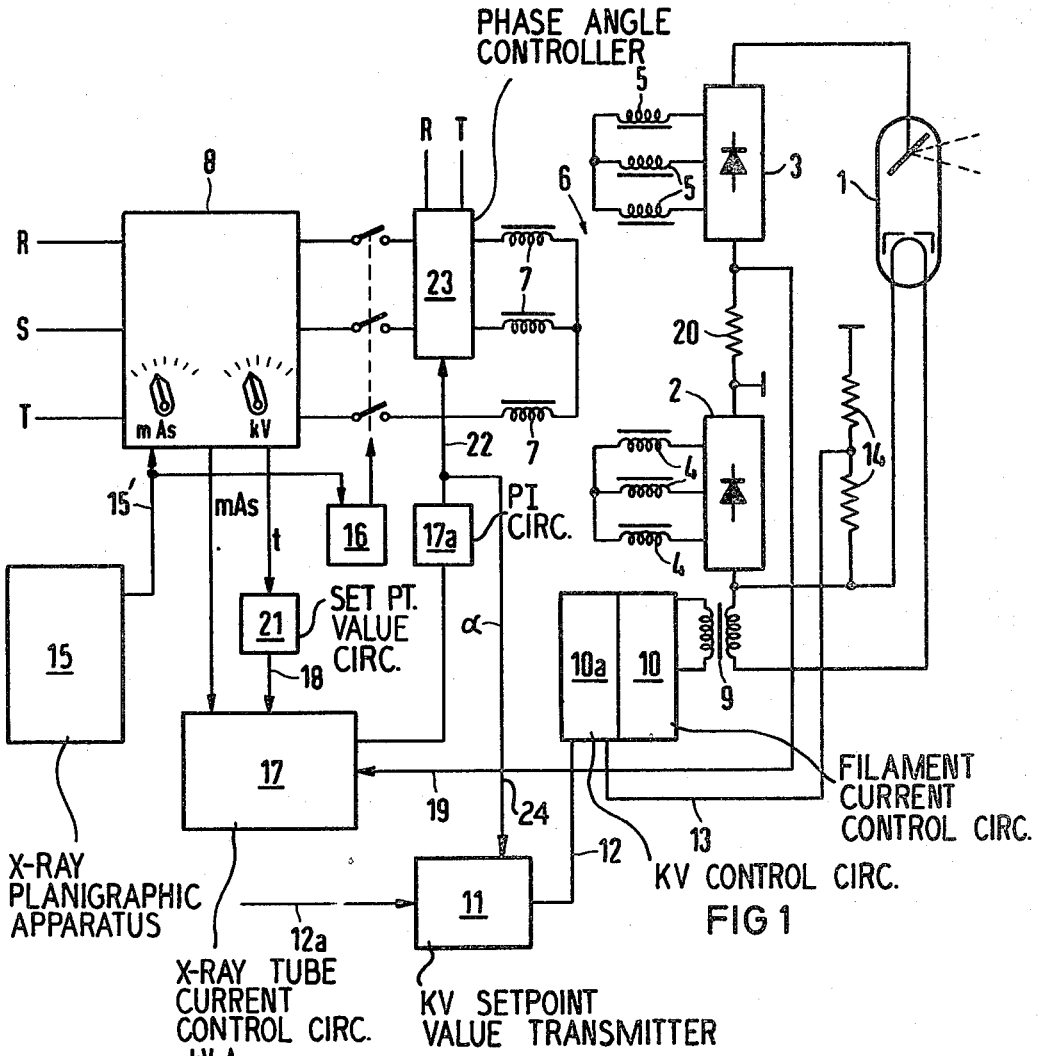
FIG. 1 shows the circuit diagram of an x-ray diagnostic system according to the invention.

In FIG. 1 an x-ray tube 1 is shown which receives its high voltage from two high voltage rectifiers 2 and 3, connected in series relative to one another, which rectifiers are supplied by two secondary winding groups 4 and 5 of a three-phase-high-voltage transformer 6. The supply of the primary winding group 7 of the high voltage transformer 6 proceeds via a switch cabinet 8 from the three-phase mains. The filament current for the x-ray tube 1 is supplied by a filament transformer 9 which is connected to a control element 10 for controlling the filament current. The filament current control circuit 10 is activated by the output signal of a kV-control circuit **10*a* which possesses a desired (or setpoint) value input 12 and an actual value input 13. The actual value signal for the x-ray tube voltage is tapped at a voltage divider 14 in the high voltage circuit. The desired or setpoint value signal for the KV-control unit 10*a* is supplied by a setpoint value transmitter 11 which receives the KV-desired value from the switch cabinet 8 via the input 12*a***.

In the example the exposure time is specified by the selected movement path of an x-ray planigraphic apparatus 15. A signal corresponding to the fixed exposure time is supplied to one input 15' of the switch cabinet 8. On the switch cabinet 8, adjustment means for the mAs-product and the x-ray tube voltage are present. The adjustment means for the x-ray tube voltage produces the signal for the input **12*a*. The exposure time is controlled by a time switch 16 which is activated by the signal at input 15' of the switch cabinet 8**.

The illustrated x-ray diagnostic system possesses an x-ray tube current control unit 17 to which a desired value signal is supplied at the input 18 and an actual value signal for the x-ray tube current is supplied at the input 19. The actual value signal is tapped on a series resistance 20 in the high voltage circuit between the two high voltage rectifiers 2 and 3. The desired value signal at the input 18 can be generated by a setpoint value circuit 21 which determines the desired value signal from the adjusted mAs-product and the specified exposure time. In the illustrated example, however, only one mA-desired value is formed for every time value. The mAs-gradation proceeds by means of a corresponding amplification switch-over of the x-ray tube current control unit 17.

The output signal of the x-ray tube current control unit 17, which corresponds to the difference between the actual- and desired-value of the x-ray tube current, is supplied to a PI-control unit 17*a* which, via a line 22, activates a phase angle control device 23 in the primary circuit of the high voltage transformer and determines the phase angle $\alpha$, at which the mains voltage is through-connected to the high voltage transformer 6. The phase angle controller 23 is switched on in the two phases R and S and is synchronized by the phases R and T. A phase angle control device which can be employed here is described in the German Pat. No. 2,401,774 and in the corresponding U.S. Pat. No. 3,978,339. The phase angle $\alpha$ is altered upon occurrence of a difference between the desired value and the actual value of the x-ray tube current until this difference is zero.

Within a predetermined range up to a phase angle of 120° the mean value of the x-ray tube current can be altered via the phase-angle without the peak value of the x-ray tube current being changed. If this range is exceeded, then, in the case of a further change of the phase-angle, in addition to the mean value of the x-ray tube current changing, also the peak value of the x-ray tube voltage changes. The kV-control unit device 10*a* becomes effective and influences, via the control element 10, the filament current of the x-ray tube 1 and hence additionally the x-ray tube current. This additional x-ray tube current change must again be compensated via an additional change in the phase-angle of the phase angle control device 23. Thus, in the steady state of the control loop, x-ray tube current and x-ray tube voltage always correspond to the adjusted desired values.

In order to correct the dose change in the film plane in the case of a change of the waveform of the x-ray tube voltage, the desired value for the x-ray tube voltage, supplied by the switch cabinet 8, is corrected via input 24 to kV setpoint value transmitter 11 in dependence upon the phase-angle $\alpha$, with the object of a dose correction in the setpoint value transmitter 11.

Figure 2:
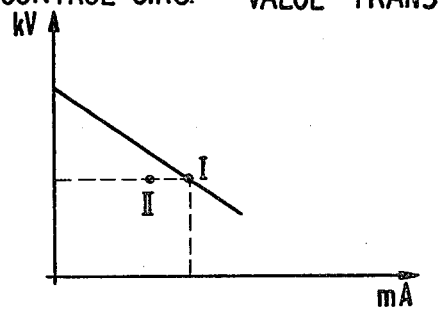
FIG. 2 shows a graphic illustration useful in explaining the operation of the embodiment of FIG. 1.

The basic adjustment of the x-ray tube current (operating point I, FIG. 2) prior to an exposure can take place via the control element 10. The filament current of the x-ray tube 1 is here a function of the selected load line, of the selected mAs-product, and the selected x-ray tube voltage. The transition from operating point I to the necessary operating point II proceeds via the phase angle control device 23.

Instead of the phase angle control device 23, also an electronic switch can be provided as a key switch which is operated with a pulse-duty factor which corresponds to the mean value of the x-ray tube current, necessary for the desired mAs-product, and which is activated synchronized by the mains (or power supply) such that the peak value of the x-ray tube voltage remains constant in the case of change of the pulse duty factor and which switch is disposed in the d.c. current branch of a rectifier bridge in the primary circuit.

For the keying of the x-ray tube current, means can also be provided for controlling the grid of a triode x-ray tube with a suitable voltage; for example, voltage pulses.

The control of the x-ray tube voltage can also proceed via a triode in the high voltage circuit of the x-ray diagnostic generator at which the voltage drop is adjusted via a control voltage such that the desired x-ray tube voltage is present. In this case, the control of the x-ray tube current can take place via the filament current by means of continuous alteration of the x-ray tube current. However, instead of control of the x-ray tube voltage via a triode in the high voltage circuit, it is also possible to control the x-ray tube voltage via a continuously variable grid bias voltage of a grid-controlled x-ray tube.

It will be apparent that many modifications and variations may be effected without departing from the scope of the novel concepts and teachings of the present invention.

We claim as our invention:

1. An x-ray diagnostic system comprising an x-ray tube for supplying x-ray energy at a film plane, supply means for supplying x-ray tube voltage to said x-ray tube, means for the fixed specification of the exposure time of an x-ray photograph, and adjustment means for selecting the x-ray tube voltage and the mAs-product, characterized in that an x-ray tube current control loop for controlling the x-ray tube current is present which controls the x-ray tube current on the basis of the fixed exposure time and the selected mAs-product, said x-ray tube current control loop comprising actual x-ray tube current sensing means for sensing the actual value of x-ray tube current, x-ray tube current setpoint means controlled in accordance with the fixed specification of the exposure time, and being operable in conjunction with the adjustment means for selecting mAs-product, to provide a corresponding setpoint value of x-ray tube current, and x-ray tube current control means for controlling the x-ray tube current and responsive to deviations of the actual x-ray tube current as sensed by said actual x-ray tube current sensing means, from the setpoint value of x-ray tube current as provided by said x-ray tube current setpoint means, to tend to maintain the actual value of x-ray tube current at said setpoint value, said supply means comprising a high voltage transformer (6) having a primary circuit, and said x-ray tube current control loop comprising a keying circuit (23) for controlling the x-ray tube current, arranged in the primary circuit of the high voltage transformer (7).

2. An x-ray diagnostic system according to claim 1, characterized in that the keying circuit is formed by a phase angle controller (23).

3. An x-ray diagnostic system according to claim 1, characterized in that the keying circuit exhibits an electronic switch which is actuated with a pulse duty factor which corresponds to the desired x-ray tube current and which is operated synchronized by the power supply (or mains) such that the peak value of the x-ray tube voltage remains constant in the case of change of the pulse duty factor and which electronic switch is disposed in the d.c. current branch of a rectifier bridge in the primary circuit.

4. An x-ray diagnostic system according to claim 1, characterized in that control loop means (10 through 14) for controlling the x-ray tube voltage is present.

5. An x-ray diagnostic system according to claim 4 characterized in that, the control loop means (10 through 14) for the x-ray tube voltage comprises a setpoint value transmitter circuit (11) connected with said x-ray tube current control loop (17-23) for receiving a phase angle control signal ($\alpha$) therefrom, and being responsive to said phase angle signal ($\alpha$) to correct the setpoint value for x-ray tube voltage for obtaining a fixed dose in the film plane.

6. An x-ray diagnostic system according to claim 4, characterized in that said control loop means is operative for adjustment of the filament current of the x-ray tube (1), so that the voltage drop in the supply means (2-7) brought about by the x-ray tube current, becomes so adjusted that the desired x-ray tube voltage is present.

7. An x-ray diagnostic system according to claim 6, characterized in that, the control loop means (10 through 14) for the x-ray tube voltage comprises a setpoint value transmitter circuit (11) connected with said x-ray tube current control loop (17–23) for receiving a phase angle control signal ($\alpha$) therefrom, and being responsive to said phase angle signal ($\alpha$) to correct the setpoint value for x-ray tube voltage for obtaining a fixed dose in the film plane.

* * * * *